US008974036B2

(12) United States Patent
Kato

(10) Patent No.: US 8,974,036 B2
(45) Date of Patent: Mar. 10, 2015

(54) INK DISCHARGE APPARATUS

(75) Inventor: Yoshinori Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/075,114

(22) Filed: Mar. 29, 2011

(65) Prior Publication Data

US 2011/0310170 A1 Dec. 22, 2011

(30) Foreign Application Priority Data

Jun. 17, 2010 (JP) ..... 2010-138304

(51) Int. Cl.
*B41J 2/165* (2006.01)

(52) U.S. Cl.
CPC ..... *B41J 2/16511* (2013.01)
USPC ..... 347/30; 347/29; 347/32

(58) Field of Classification Search
USPC ..... 347/23, 29, 32, 30, 33
See application file for complete search history.

(56) References Cited

U.S. PATENT DOCUMENTS 6,951,381 B2 * 10/2005 Shigeno et al. ..... 347/29
7,832,832 B2 * 11/2010 Yoshida ..... 347/32
2002/0012023 A1 * 1/2002 Shigeno ..... 347/29
2003/0227505 A1 * 12/2003 Tanaka et al. ..... 347/29
2004/0041875 A1 * 3/2004 Yazawa et al. ..... 347/23
2004/0041877 A1 * 3/2004 Shigeno et al. ..... 347/29
2005/0243122 A1 * 11/2005 Usuda ..... 347/29
2007/0296754 A1 12/2007 Hiraki et al.
2008/0266352 A1 * 10/2008 Takahashi ..... 347/32
2009/0141073 A1 * 6/2009 Umeda ..... 347/30

FOREIGN PATENT DOCUMENTS

JP 2004-009576 A 1/2004
JP 2007-331269 A 12/2007

* cited by examiner

*Primary Examiner* — Matthew Luu
*Assistant Examiner* — Lily Kemathe
(74) *Attorney, Agent, or Firm* — Baker Botts L.L.P.

(57) ABSTRACT

There is provided an ink discharge apparatus including a discharge head provided with a nozzle surface having a first nozzle which is formed in the nozzle surface and via which a liquid droplet of a first ink is discharged and a second nozzle which is formed in the nozzle surface and via which a liquid droplet of a second ink, having a color deeper than a color of the first ink, is discharged; a maintenance device which performs maintenance of the discharge head; and an apparatus body in which the maintenance device is arranged. The maintenance device includes a suction cap which is arranged with respect to the apparatus body, with a predetermined clearance, so the suction cap is rockable three-dimensionally; and an urging mechanism which urges a corner portion of the suction cap in a direction orthogonal to the nozzle surface.

9 Claims, 10 Drawing Sheets

INK DISCHARGE APPARATUS

CROSS REFERENCE TO RELATED APPLICATION

The present application claims priority from Japanese Patent Application No. 2010-138304 filed on Jun. 17, 2010 the disclosure of which is incorporated herein by reference in its entirety.

BACKGROUND OF THE INVENTION

1. Field of the Invention

The present invention relates to an ink discharge apparatus which performs printing with respect to a recording medium such as paper (paper sheet) with ink droplets of an ink discharged from a plurality of nozzles provided on a nozzle surface of a discharge head.

2. Description of the Related Art

An ink discharge apparatus has a discharge head provided with a nozzle surface. For example, a plurality of nozzles are disposed on the nozzle surface; and liquid droplets of a deep color ink are jetted from deep color nozzles and liquid droplets of a light color ink are jetted from light color nozzles onto a recording medium such as paper (paper sheet), thereby performing printing on the recording medium. When such a printing operation is repeated, in a case that time interval from the previous printing to the next printing becomes great, etc., clogging of the nozzles occurs in some cases. In order to solve the clogging, a maintenance device is provided on a body of the ink discharge apparatus (apparatus body).

The maintenance device is provided with a suction cap and a suction mechanism. The suction cap is brought into contact with the nozzle surface of the discharge head. In a state that the suction cap is brought into contact with the nozzle surface, the suction mechanism is connected to a suction port provided on the suction cap, and the suction mechanism performs suction operation via the suction port, thereby removing ink solid matter, etc. clogged in the nozzles (so-called suction purge process).

In the suction purge process, the suction cap into which the ink is discharged is separated away from the nozzle surface so as to suck and remove the ink discharged in the suction cap, and the suction mechanism performs suction operation in a state that the contact state between the suction cap and the nozzle surfaces is released.

Conventionally, there has been suggested an ink discharge apparatus having a construction in which the suction cap is inclinable with respect to a carriage. In the ink discharge apparatus, the suction cap is inclined so that a portion, of the suction cap on a side of one end thereof (one end side), is open with respect to the nozzle surface and that the ink adhered to the nozzle surface is collected to the portion on the one end side of the suction cap; and the ink inside the suction cap is sucked.

SUMMARY OF THE INVENTION

Generally, in ink discharge apparatuses, a position at which the nozzle surface is installed in the discharge head (install position) is varied due to the installation error during the manufacture, etc. In order to tolerate this variation in the install position and to securely obtain the contact of the suction cap to the nozzle surface, a construction is considered in which the suction cap is installed (arranged) in the apparatus body with a predetermined clearance to make the suction cap be freely rockable three-dimensionally. Alternatively, another construction is considered in which the suction cap is provided with a partition wall so that the deep color nozzles and the light color nozzles can be covered with separate spaces, respectively, in a state that the suction cap is brought into contact with the nozzle surface. For example, a cap chamber of the suction cap is partitioned into two areas which are a deep color ink chamber and a light color ink chamber.

However, in a case that the suction cap is constructed to be three-dimensionally rockable, there is a fear that the ink might flow out of a cap chamber over the partition wall and inflow (enter) into another ink chamber adjacent to the cap chamber and mix with the ink in the adjacent cap chamber. In this situation, for example, if the deep color ink inflows into the light color ink chamber, the inside of the light color ink chamber is dirtied (stained) by the deep color ink. Such a dirtiness in the light color ink chamber cannot be completely removed by the suction alone. As a result, when the suction purge process is again performed in a state that the inside of the cap chamber (light color ink chamber) is dirtied by the deep color ink, there is a fear that the dirtied suction cap might be brought into contact with the nozzle surface, which in turn causes the deep color ink to adhere to the light color nozzles, thereby dirtying the light color nozzles.

An object of the preset teaching is to provide an ink discharge apparatus capable of suppressing the adhesion of the deep color ink to the light color nozzles and preventing the light color nozzles from being dirties by the deep color ink in a structure in which the cap member (suction cap member) is configured to be rockable for the purpose of tolerating the variation in the install position of the nozzle surface.

According to a first aspect of the present teaching, there is provided an ink discharge apparatus which discharges a first ink and a second ink having a color deeper than a color of the first ink, the ink discharge apparatus including:

a discharge head provided with a nozzle surface having a first nozzle which is formed in the nozzle surface and via which a liquid droplet of the first ink is discharged and a second nozzle which is formed in the nozzle surface and via which a liquid droplet of the second ink is discharged; and a maintenance device which performs maintenance of the discharge head, the maintenance device including:

a suction cap which is brought into contact with the nozzle surface to cover the first and second nozzles, and which has a partition wall and a suction port formed therein, the partition wall partitioning a space, defined between the suction cap and the nozzle surface in a state that the suction cap is brought into contact with the nozzle surface, into a first ink chamber facing the first nozzle and a second ink chamber facing the second nozzle, a suction mechanism which is connected to the suction port of the suction cap, and an urging mechanism which urges a corner portion of the suction cap in a third direction orthogonal to the nozzle surface; and an apparatus body in which the maintenance device is arranged;

wherein the corner portion is located at an end, of the suction cap, on a side of the first ink chamber in a first direction, that is from the first nozzle toward the second nozzle and is parallel to the nozzle surface, and is located at an end in one side in a second direction, that is orthogonal to the first direction and is parallel to the nozzle surface; and the suction cap is arranged with respect to the apparatus body with a predetermined clearance so that the suction cap is rockable in each of the first direction, the second direction and the third direction.

In general, the install position of the nozzle surface in the discharge head is varied due to the installation error during the manufacture, etc. In order to ensure that the suction cap is brought into contact with the nozzle surface while tolerating the variation in the install position, the suction cap is arranged, with the predetermined clearance, in the apparatus body to be rockable three-dimensionally in each of the first direction, the second direction orthogonal to the first direction and parallel to the nozzle surface and the orthogonal direction (third direction) orthogonal to the nozzle surface. Further, the suction cap is provided with the partition wall and is capable of covering the second nozzle (deep color nozzle) and the first nozzle (light color nozzle) with separate spaces, respectively, in a state that the suction cap is brought into contact with the nozzle surface.

However, since the suction cap is configured to be rockable in the three directions as described above, there is a fear that the ink might flow or move over or across the partition wall. In such a situation, if, for example, the second ink (deep color ink) inflows or enters into the side of the first ink chamber (light color ink chamber), the inside of the first ink chamber is dirtied by the second ink having the deep color. Such the dirtiness or stain cannot be completely removed or cleaned by the ink suction alone. As a result, when the purge process is executed again in such a state that the inside of the first ink chamber is dirtied by the second ink, there is a fear that the dirtied suction cap might be brought into contact with the nozzle surface, consequently causing the second ink to adhere to the first nozzle (light color nozzle), thereby dirtying the first nozzle.

In view of such a situation, in the ink discharge apparatus of the present teaching, the urging mechanism urges the suction cap in the orthogonal direction at the corner portion, of the suction cap, which is positioned in the suction cap at a portion of the first ink chamber, the portion being located on the opposite side opposite to the second ink chamber in the first direction and is located in the suction cap on the one side in the second direction. By urging the corner portion, of the first ink chamber, located on the opposite side opposite to the second ink chamber, the suction cap is inclined, while the suction cap is being separated away from the nozzle surface, so that a portion, of the suction cap, on the side of the second ink chamber is separated and away from the nozzle surface by a greater distance than another portion, of the suction cap, on the side of the first ink chamber. With this, even if the ink flows or moves over the partition wall, it is possible to make the first ink having the light color inflow (enter) into the second ink chamber, rather than the second ink having the deep color inflowing into the first ink chamber as described above. As a result, even when the first ink flows into and mixes with the second ink, the influence on the tint or color of the second ink is small than in a case that the second ink flows into and mixes with the first ink, thereby making it possible to suppress the influence on the tint or color of the ink to be considerably small. Therefore, it is possible to suppress the adhesion of the second ink to the first nozzle and prevent the first nozzle from being dirtied.

According to the present teaching, in the structure in which the cap body (cap member) is configured to be rockable to tolerate the variation in the install position of the nozzle surface, it is possible to suppress the adhesion of the second ink having the deep color to the first nozzle and suppress the dirtiness of the first nozzle due to the second ink.

DESCRIPTION OF THE PREFERRED EMBODIMENTS

In the following, an embodiment of the present teaching will be explained with reference to the drawings. In this embodiment, the present teaching is applied to a printer which performs printing of a desired text (letter) and/or a desired image on a recording paper (recording sheet) by jetting (discharging) an ink from a discharge head onto the recording paper.

Figure 1:
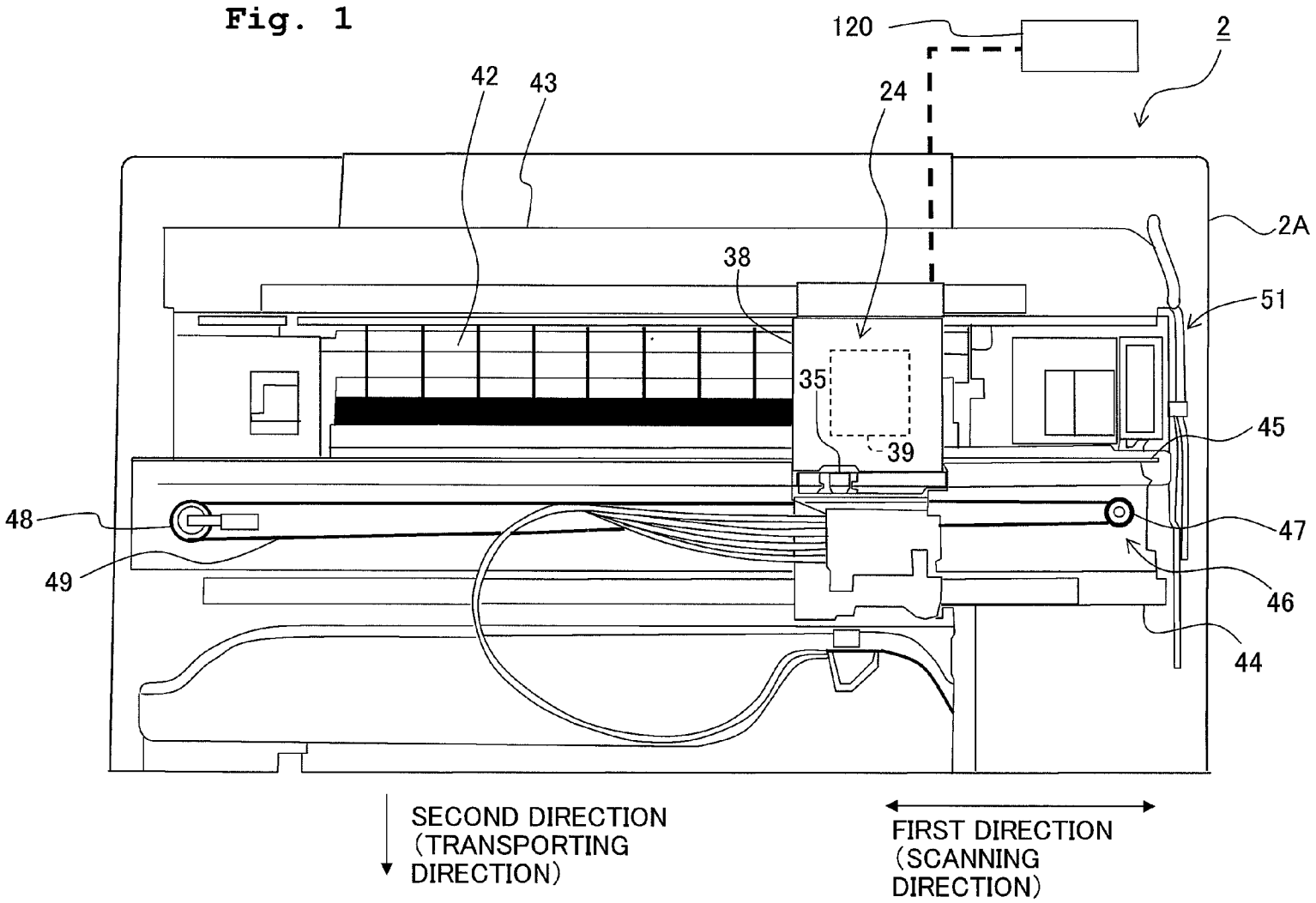
FIG. 1 is a plane view showing main constitutive parts or elements of a printer.

With reference to FIG. 1, an explanation will be given about the schematic construction of a printer 2 as an embodiment of the ink discharge apparatus of the present teaching.

The printer 2 has an apparatus body 2A which is provided with a printing unit 24. The printing unit 24 includes a discharge head 39 of the ink-jet system and a carriage 38 in which the discharge head 39 is provided on a side of the bottom surface of the carriage 38. The carriage 38 is supported to be slidable in a scanning direction (left/right direction in FIG. 1) orthogonal to a transporting direction of the recording paper (direction from the upper side to the lower side of FIG. 1).

A pair of guide rails 43, 44 are arranged with respect to the carriage 38 on a side of the both end portions of the carriage 38 in the transporting direction, respectively. The guide rails 43, 44 face (are opposite to) each other with a predetermined distance in the transporting direction of the recording paper therebetween, and extend in the scanning direction. The guide rails 43, 44 are disposed inside the casing or housing of the printer 2, and construct a part of a frame which supports the respective members constructing the printer 2. The carriage 38 is arranged to straddle the guide rails 43, 44 and to be slidable movable in the scanning direction.

An edge portion 45, of the guide rail 44, located on the upstream in the transporting direction is bent upward substantially at right angle. The carriage 38 supported by the guide rails 43, 44 pinches and holds the edge portion 45 with holding members 21, 22 (see FIG. 2, to be described later on) so that the carriage 38 is slidably movable. With this, the carriage 38 is positioned with respect to the transporting direction of the recording paper, and the carriage 38 is slidably movable in the scanning direction.

A belt drive-transmitting mechanism 46 is arranged on the upper surface of the guide rail 44. The belt drive-transmitting mechanism 46 has a driving pulley 47, a driven pulley 48 and an endless loop-shaped belt 49.

The driving pulley 47 and the driven pulley 48 are arranged on both ends in the scanning direction, respectively. The endless loop-shaped belt 49 is arranged to be stretched between the driving pulley 47 and the driven pulley 48. A driving shaft of a carriage motor (not shown) disposed inside the printer 2 is connected to the shaft of the driving pulley 47. Rotary driving force of the carriage motor is transmitted to the driving pulley 47 to rotate the driving pulley 47, which in turn makes the belt 49 move in circular motion.

The carriage 38 is connected to the belt 49 on a side of the bottom surface thereof. Accordingly, the carriage 38 moves slidably (slides) on the guide rails 43, 44, with the end portion 45 as the reference, based on the circular motion of the belt 49. In such a manner, the carriage motor moves the carriage 38. The discharge head 39 is placed on or attached to such a carriage 38, and the discharge head 39 reciprocates in the scanning direction.

A platen 42 is disposed at a position below the discharge head 39 so that the platen 49 faces the discharge head 39. The platen 42 is arranged across a center portion of a moving range of the carriage 38, namely across an area in which the recording paper passes. Since the width of the platen 42 is sufficiently greater than the maximum width of a transportable recording paper, the both end portions of the recording paper always pass on the platen 42.

A maintenance device 51 is arranged at a range or region, in the apparatus body 2A of the printer 2, in which the recording paper does not pass, namely a range outside the printing region by the discharge head 39. In FIG. 1, the maintenance device 51 is arranged at the right end portion of the platen 42. In the discharge head 39 of the ink jet system, when a long period of time elapsed as time interval from previous printing to next printing, etc., then clogging of nozzles 40 (see FIG. 2) occurs in some cases. Accordingly, the maintenance device 51 prevents the clogging of nozzles by preventing the ink inside the nozzles 40 in the discharge head 39 from being dried, by sucking and removing air bubbles and/or foreign matter from the nozzles 40, etc. In the embodiment, when no printing is performed, the carriage 38 is arranged at a position above or over the maintenance device 51. Namely, the carriage 38 stands by at the position above the maintenance device 51 until next printing instruction is given. The maintenance device 51 will be described in detail later on. Note that the printing operation of the printer 2, the maintenance process of the maintenance device 51 (for example, a purge process as described later on), etc. are controlled by a controller 120 (see FIG. 1). The controller 120 includes, for example, a CPU, a ROM, a RAM, etc., and controls revolution of the carriage motor which drives the carriage 38, driving of a cam mechanism 60 (to be described later on) of the maintenance device 51, driving of a suction mechanism (to be described later on), etc.

Next, an explanation will be given about the construction of the carriage 38 on the side of the bottom surface thereof, with reference to FIG. 2.

Figure 2:
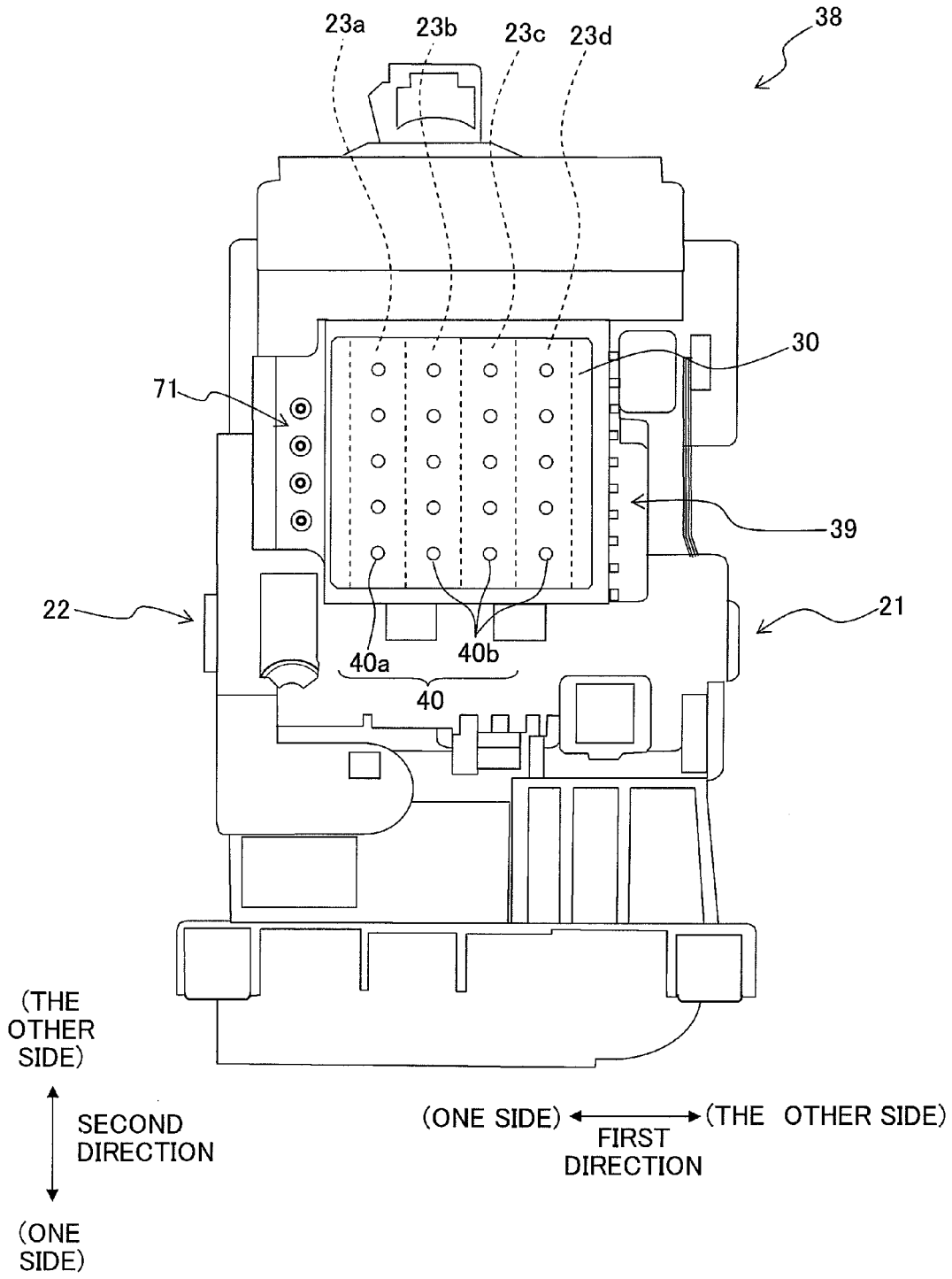
FIG. 2 is a bottom view showing construction of a carriage on the side of bottom surface thereof.

As shown in FIG. 2, the discharge head 39 is arranged on the bottom surface of the carriage 38, and a nozzle surface 30 of the discharge head 39 is exposed on the side of the lower surface of the carriage 38. A plurality of nozzles 40 are formed in the nozzle surface 30. A plurality of color inks (four color inks in the embodiment) are supplied to the discharge head 39 from ink cartridges, respectively, arranged inside the printer 2. Four sub-tanks 23*a*-23*d*, storing the four color inks which are to be supplied to the discharge head 39 from the ink cartridges respectively, are mounted or placed inside the carriage 38. Black, cyan, magenta and yellow inks are stored in the sub-tanks 23*a*-23*d*, respectively. The nozzles 40 include black color nozzles 40*a* jetting liquid droplets of the black color ink supplied from the sub-tank 23*a* and color nozzles 40*b* jetting liquid droplets of the color inks (cyan, magenta and yellow inks) supplied from the sub-tanks 23*b*-23*d*. While the carriage 38 is reciprocating in the scanning direction, minute droplets of the inks are selectively discharged from the nozzles 40 of the discharge head 39. With this, printing is performed on a recording medium transported on the platen 42.

As described above, the holding members 21, 22 which pinch and hold the edge portion 45 of the guide rail 44 are provided on the side of the bottom surface of the carriage 38. The holding member 21 is a fixed-type pinching/holding member which is fixed with respect to the carriage 38; on the other hand, the holding member 22 is configured to be a movable-type pinching/holding member which is movable with respect to the carriage 38. Generally, in the printer 2, the install position of the nozzle surface 30 in the discharge head 39 is varied (deviated, fluctuated) in some cases due to any installation error during the manufacture, etc. Due to such variation in the install position, in some cases, the transporting direction of the recording paper and the alignment (arrangement) direction of the nozzles 40 of the discharge head 39 (up/down direction in FIG. 2) are not parallel. Even in such a situation, by adjusting the position of the above-described pinching/holding member 22 of the movable type, it is possible to reciprocate the discharge head 39 in the scanning direction while making the transporting direction of the recording paper and the arrangement direction of the nozzles 40 be parallel to each other.

Note that the color ink (color inks) and the black color ink correspond to the first ink (light color ink) and the second ink (deep color ink) and the black color nozzle 40*a* and the color nozzle 40*b* correspond to the second nozzle (deep color nozzle) and the first nozzle (light color nozzle), respectively, of the present teaching.

Next, an explanation will be given about the maintenance device 51 with reference to FIGS. 3 to 5.

The maintenance device 51 includes a suction cap 55, an exhaust cap 56, an outer frame section 50 supporting the suction cap 55 and the exhaust cap 56, a maintenance base 57 to which the outer frame section 50 is attachable or mountable, a changeover valve 63, and a cam mechanism 60.

When the carriage 38 is moved to a capping position (position indicated by two-dot chain lines in FIG. 6 which will be described later on) set to be directly above the maintenance device 51, the suction cap 55 is brought into contact with the nozzle surface 30 of the discharge head 39 so as to cover the plurality of nozzles 40. As shown in FIGS. 3 and 4, the suction cap 51 is provided with an outer periphery portion 58 at the outer periphery portion thereof. Inside the outer periphery portion 58, a partition wall 52 is provided which partitions an inner space, defined by the nozzle surface 30 and the suction cap 55 in a state that the suction cap 55 is brought into contact with the nozzle surface 30, into two spaces. Namely, the partition wall 52 partitions (divides) the inner space into a black color ink chamber 55A which is located on one side in the scanning direction parallel to the nozzle surface 30 (left side in FIGS. 3 and 4) and which faces or is opposite to the black color nozzles 40*a*, and a color ink chamber 55B which is located on the other side in the scanning direction (right side in FIGS. 3 and 4) and which faces or is opposite to the color nozzles 40*b*. Note that the scanning direction parallel to the nozzle surface corresponds to the first direction of the present teaching. In the following, the scanning direction is appropriately referred to as the "first direction".

Figure 3:
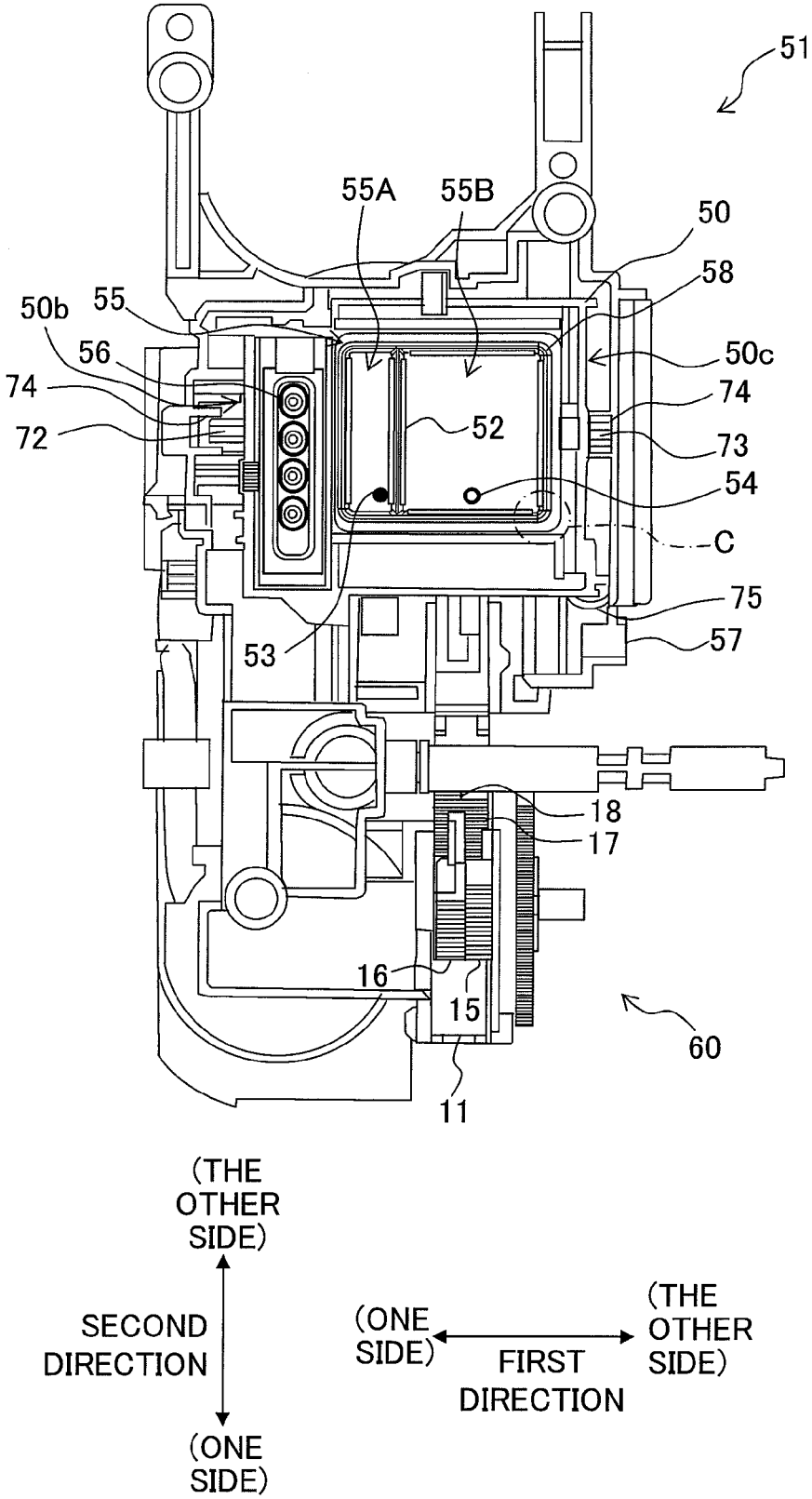
FIG. 3 is a plane view showing main constitutive parts or elements of a maintenance device.

Suction ports 53 and 54 are provided on the inside of the outer periphery portion 58 and in the black color ink chamber 55A and the color ink chamber 55B, respectively, each at a position on one side in the transporting direction (lower end side in FIG. 3). A pump 110 (see FIG. 10) as the suction mechanism is connected to the suction ports 53 and 54. Here, the transporting direction means a direction orthogonal to the first direction and parallel to the nozzle surface 30, and corresponds to the second direction of the present teaching. In the followings, the transporting direction is appropriately referred to as the "second direction".

The outer frame section 50 supporting the suction cap 55 is supported with respect to the maintenance base 57 elastically in the up and down direction via a plurality of coil springs 65 disposed between a lower portion of the outer frame section 50 and the bottom surface of the maintenance base 57 (see FIGS. 6 and 7 which will be described later on). Since the outer frame section 50 is elastically supported in such a manner, the suction cap 55 is arranged with respect to the maintenance base 57 (in other words, with respect to the apparatus body 2A) with a predetermined clearance to be rockable in each of the first direction, the second direction and the vertical direction orthogonal to the first and second directions. The vertical direction described above corresponds to the third direction of the present teaching. In the followings, the vertical direction is appropriately referred to as the "third direction".

Note that the present teaching is not limited to the construction in which the outer frame section 50 is elastically supported with respect to the maintenance base 57 via the coil springs 65. For example, it is allowable that a guide groove is formed in the maintenance base 57 and a projection, etc. which is engageable with the guide groove is formed on the outer frame section 50, and that the outer frame section 50 is supported with respect to the maintenance base 57 via the projection, etc. engaged with the guide groove. In such a case and when the width of the guide groove is formed to be greater than the width of the projection, the outer frame section 50 is rockable in each of the first to third directions by an amount corresponding to a clearance between the guide groove and the projection.

The exhaust cap 56 is brought into contact with an opening surface 71 (see FIG. 2) formed with exhaust ports which are connected to the sub-tanks 23*a*-23*d* communicating with the discharge head 39. The exhaust cap 56 is used to suck and exhaust air bubbles from an ink flow passage upstream of the nozzles 40.

The suction cap 55 is constructed to be rockably movable as described above. Accordingly, even in a case that the install position of the nozzle surface 30 in the discharge head 39 is varied due to the installation error, etc., as described above, it is possible to ensure that the suction cap is brought into contact with the nozzle surface 30 while tolerating the variation of the install position.

Note that as shown in FIG. 3, the outer frame section 50 is provided with projections 72 and 73 which project in the first direction at one side surface (first side surface) 50*b* (left side in FIG. 3) and the other side surface (second side surface) 50*c* (right side in FIG. 3) of the maintenance base 57, respectively. On the other hand, the maintenance base 57 is provided with groove portions 74 which are formed in the maintenance base 57 on the one side and the other side, respectively of the first direction and which guide the projections 72 and 73, respectively. The groove portions 74 regulate the movement of the outer frame section 50 toward the both sides in the second direction, and which guide the projections 72, 73 respectively so that the outer frame section 50 moves in the third direction between a contact position at which the suction cap 55 is brought into contact with the nozzle surface 30 and a separate position at which the suction cap 55 is separated and away from the nozzle surface 30. As shown in FIG. 5, each of the groove portions 74 is constructed so that a width size L2 at the upper side in the second direction is greater than a width size L1 at the lower side in the second direction. Namely, the groove portions 74 are each formed to have a reverse tapered shape gradually widening from the separate position toward the contact position in the third direction.

Figure 4:
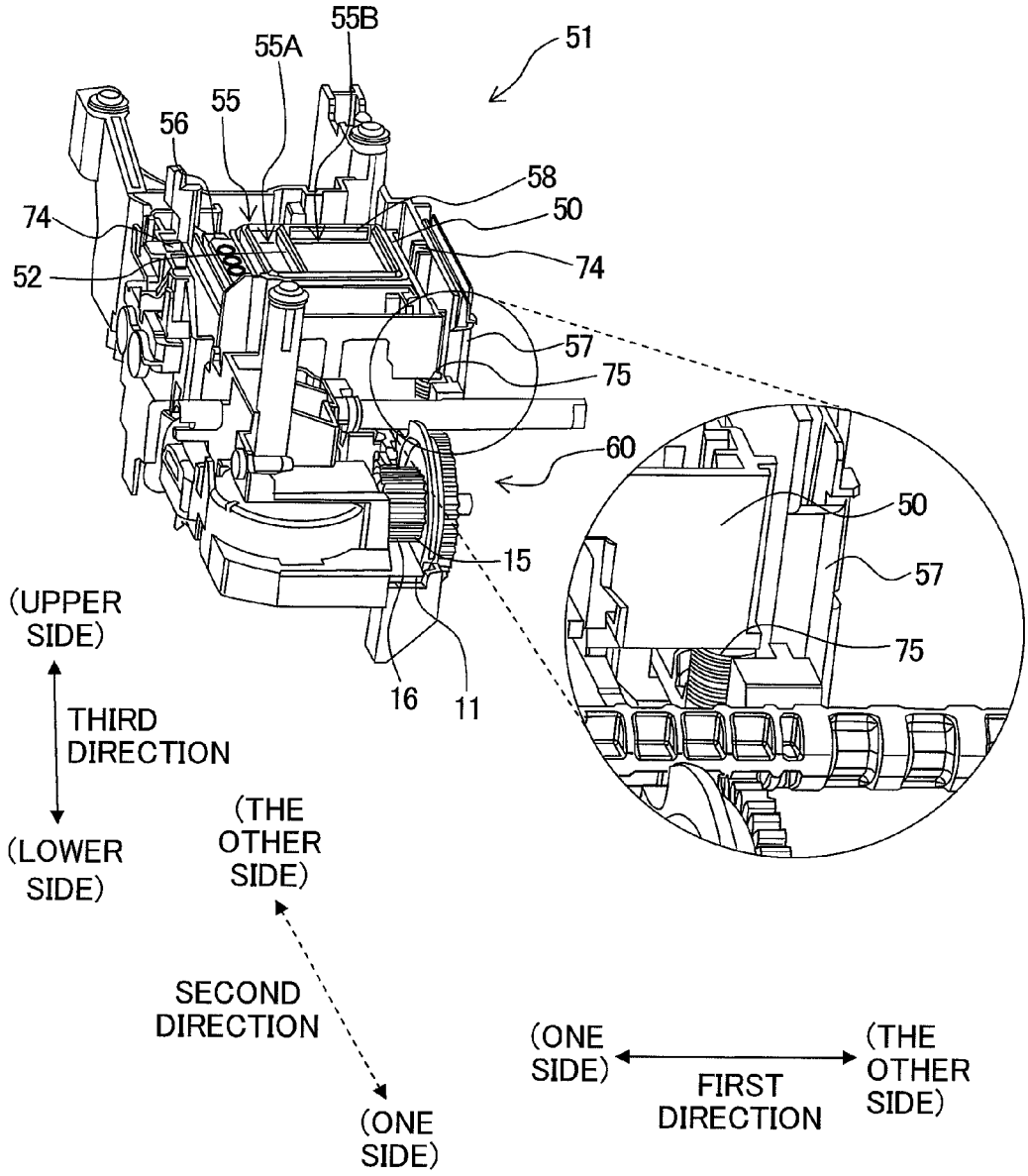
FIG. 4 is a perspective view showing the main constitutive parts or elements of the maintenance device.
Figure 5:
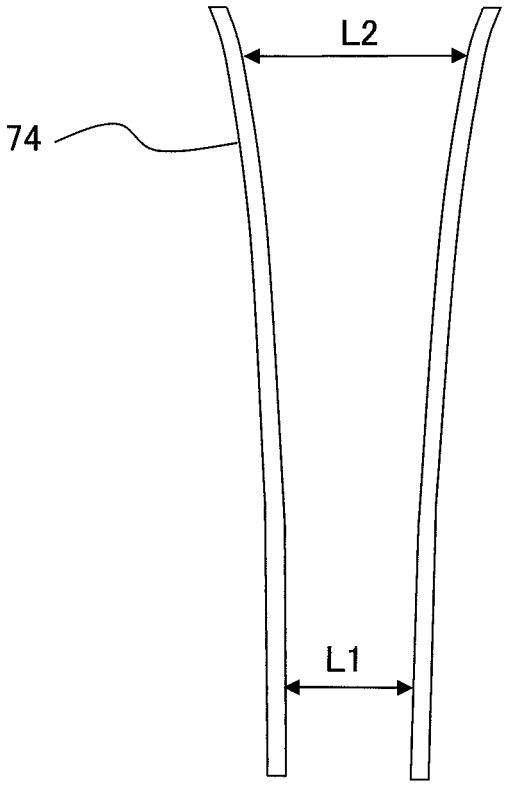
FIG. 5 is a schematic view showing expanded shape of a groove portion.

Further, as shown in FIGS. 3 and 4, the maintenance device 51 has a coil spring 75 which urges the suction cap 55 upward in the third direction in the vicinity of a corner portion C, of the color ink chamber 55B, the corner portion C being positioned on an opposite side opposite to the black color ink chamber 55A in the first direction and is positioned on a side of one end (one end side) of the suction cap 55 in the second direction. The coil spring 75 is arranged between the maintenance base 57 and the bottom surface of the outer frame section 50. The coil spring 75 corresponds to the urging mechanism of the present teaching.

The cam mechanism 60 is arranged at a position below or under the outer frame section 50. The cam mechanism 60 includes a slide cam 11, a second pinion gear 15, a third pinion gear 16, a first rack gear 17 and a second rack gear 18. The cam mechanism 60 is capable of holding the suction cap 55 at the contact position at which the suction cap 55 is brought into contact with the nozzle surface 30 and at the separate position at which the suction cap 55 is separated away from the nozzle surface 30.

Next, an explanation will be given about an operation for moving the suction cap between the contact position and the separate position by the cam mechanism 60, with reference to FIGS. 6 and 7.

Figure 6:
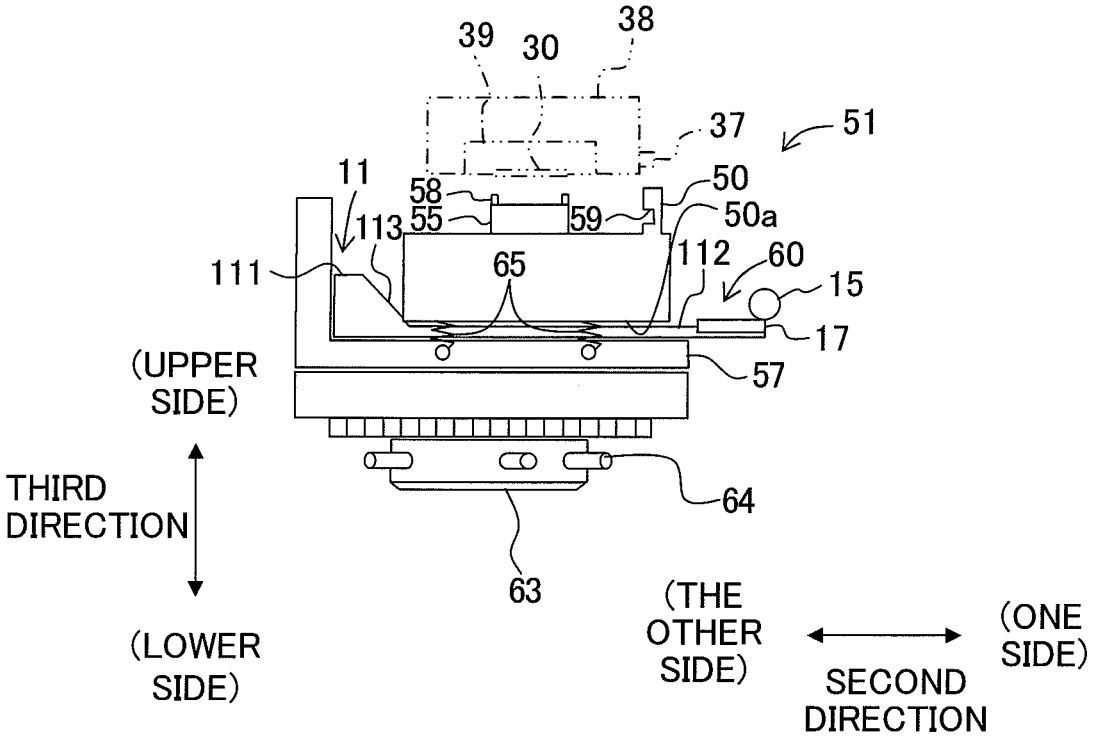
FIG. 6 is a side view schematically showing a construction of the maintenance device from the side portions or units thereof.
Figure 7A:
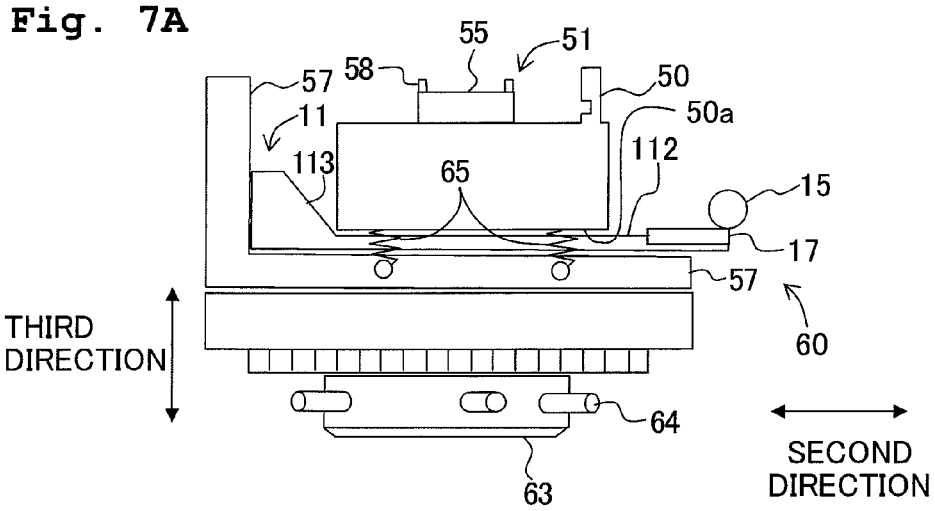
FIGS. 7A, 7B and 7C are side views each schematically showing an operation for moving a position of a suction cap.

In a case that the coil springs 65 which elastically support the outer frame section 50 are allowed to have a natural length, namely in a state that any external force is not applied to the outer frame section 50, the suction cap 55 is arranged at the separate position at which the suction cap 55 is separated away from the discharge head 39 (see FIGS. 6 and 7A). When the outer frame section 50 is pushed upward by the slide cam 11, the coil springs 65 are stretched and the suction cap 55 moves (is moved) from the separate position to the contact position (see FIG. 7C) at which the suction cap 55 is brought into contact with the discharge head 39 and covers the nozzle surface 30.

Actually, when the suction cap 55 is positioned at a position other than the contact position, the suction cap 55 assumes an inclined posture due to the urging force of the above-described coil spring 75. However, for making the explanation be easy to understand, it is assumed that in FIGS. 6 and 7 the suction cap 55 moves while assuming a horizontal posture. Change in the posture of the suction cap 55 by the coil spring 75 will be explained later on (see FIG. 8).

The changeover valve 63 is attached at a position below or under the maintenance base 57. The changeover valve 63 has tube joints 64 which are connected to the suction ports 53, 54 of the suction cap 55 and the exhaust cap 56, respectively. An end of a tube (not shown in the drawings) is connected to each of the tube joints 64, and the other end of the unillustrated tube is connected to the pump. Adjustment is made by using the changeover 63 so that at least one of the suction ports 53, 54 is communicated with the pump 110, or that the pump 110 and the exhaust cap 56 are communicated, in a state that the suction cap 55 is moved (has moved) to the contact position and covers the nozzle surface 30. At this time, when the pump 110 is driven in a state that at least one of the suction ports 53, 54 is communicated with the pump 110, the ink inside the nozzles 40 is forcibly sucked and exhausted (discharged) by the pump 110. Such an operation is referred to as suction purge process.

As shown in FIG. 6, an abutting portion 37 for defining the posture of the suction cap 55 when the suction cap 55 is brought into contact with the nozzle surface 30 is provided on the carriage 38 so that the abutting portion 37 projects from the carriage 38 in the second direction. On the other hand, a recess-shaped abutted portion 59, against which the abutting portion 37 formed on the carriage 38 abuts, is provided on the outer frame section 50 at an inner circumference surface thereof.

The slide cam 11 is supported to be movable in the second direction orthogonal to the scanning direction of the carriage 38. The slide cam 11 has a guide surface which is abutted against the lower surface (bottom portion) 50*a* of the outer frame section 50. As shown in FIG. 6, the guide surface includes a first guide surface 111 located at a high position in the vertical direction and a second guide surface 112 located at a low position in the vertical direction and an inclined surface 113 connecting the first guide surface 111 and the second guide surface 112.

As shown in FIG. 7A, in a case that only the second guide surface 112 enters (is displaced) into a gap between the lower surface 50*a* of the outer frame section 50 and the upper surface of the maintenance base 57, and that the second guide surface 112 and the lower surface 50*a* of the outer frame section 50 are brought into abutment with each other, the suction cap 55 is held (maintained) at the separate position.

Figure 7B:
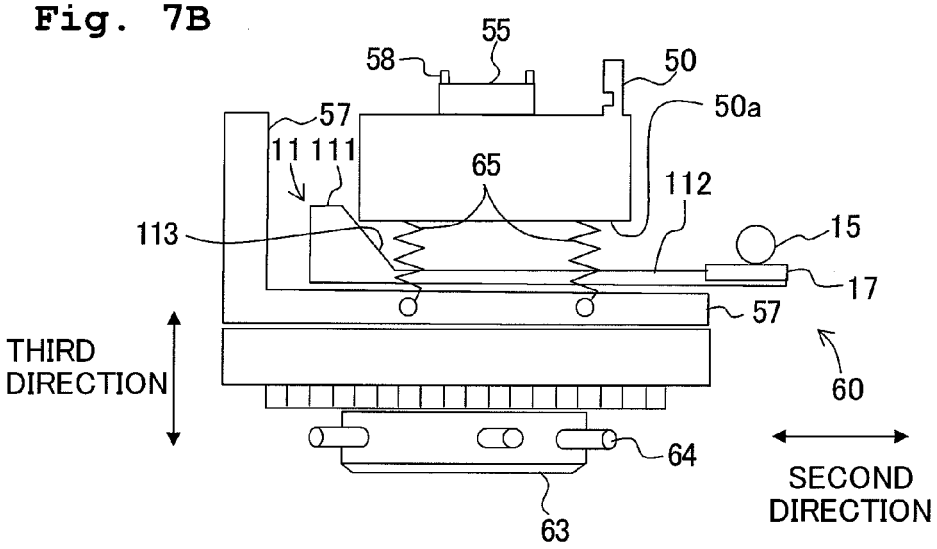

When the slide cam 11 slidably moves, by driving force transmitted from an unillustrated driving source, toward the one side in the second direction (rightward in FIG. 7); then as shown in FIG. 7B, the inclined surface 113, in addition to the second guide surface 112, also enters into the gap between the lower surface 50*a* of the outer frame section 50 and the upper surface of the maintenance base 57. With this, the second guide surface 112 is separated and away from the lower surface 50*a* of the outer frame section 50 and the inclined surface 113 is brought into abutment against the lower surface 50*a* of the outer frame section 50. As a result, the suction cap 55 moves from the separate position toward the contact position in accordance with the height of the inclined surface 113.

Figure 7C:
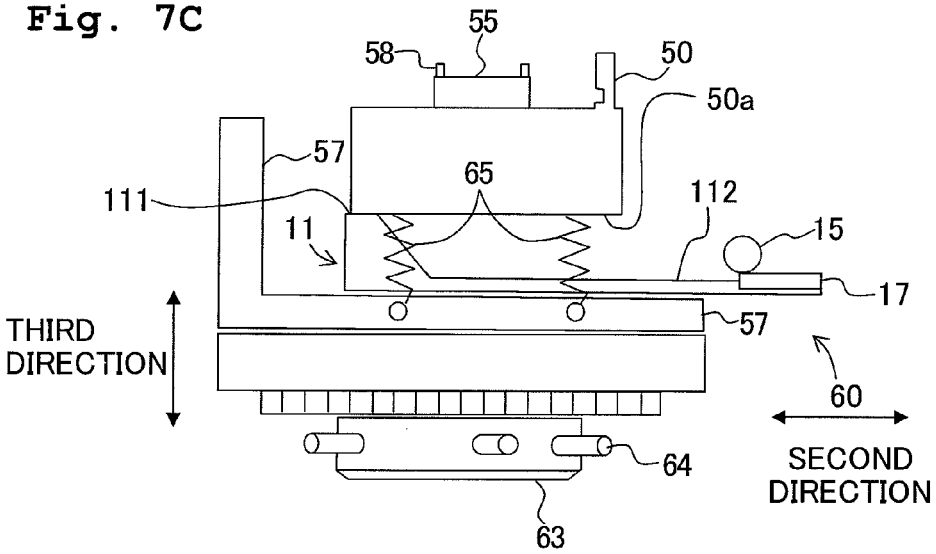

When the slide cam 11 slidably moves, by the driving force transmitted from the unillustrated driving source, further toward the one side in the second direction (rightward in FIG. 7), then as shown in FIG. 7C, the first guide surface 111, in addition to the second guide surface 112 and the inclined surface 113, also enters into the gap between the lower surface 50*a* of the outer frame section 50 and the upper surface of the maintenance base 57. With this, the inclined surface 113 is separated away from the lower surface 50*a* of the outer frame section 50, and the first guide surface 111 abuts against the lower surface 50*a* of the outer frame section 50. As a result, the suction cap 55 is held at the contact position. In such a manner, the suction cap 55 moves between the separate position and the contact position by the movement of the slide cam 11.

Next, an explanation will be given about the posture change of the suction cap 55 by the urging force of the coil spring 75, with reference to FIG. 8. Note that the states of the slid cam 11 shown in FIGS. 8A, 8B and 8C corresponds to those shown in FIGS. 7A, 7B and 7C, respectively.

Figure 8A:
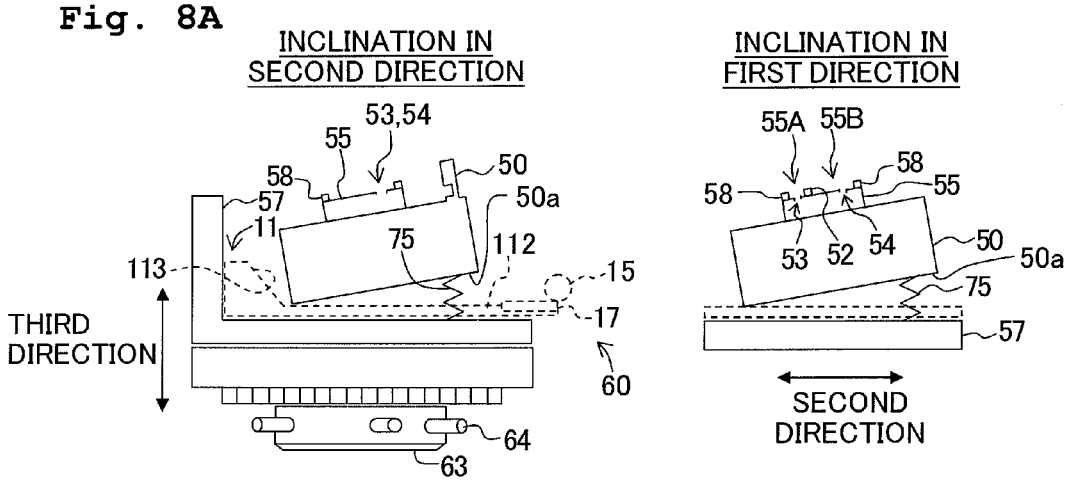
FIGS. 8A, 8B and 8C are side views each schematically showing a change in posture of the suction cap.

As shown in FIG. 8A, in a state that the suction cap 55 is held at the separate position, the outer frame section 50 is urged upward in the third direction by the coil spring 75. Here, with respect to the second direction, the coil spring 75 is disposed on the outer frame section 50 at the corner portion on the side of the suction ports 53 and 54. Therefore, the outer frame section 50 and the suction cap 55 are inclined by the urging force of the coil spring 75 so that the portion, of the suction cap 55, on the side of the suction ports 53, 54 is located in the third direction on upper side of another portion of the suction cap 55 on the opposite side opposite to the suction ports 53, 54. Further, with respect to the first direction, the coil spring 75 is disposed in the outer frame section 50 at the corner portion which is located on the opposite side opposite to the black color ink chamber 55A. Therefore, the outer frame section 50 and the suction cap 55 are inclined by the urging force of the coil spring 75 so that the portion, of the suction cap 55, on the side of the color ink chamber 55B is located in the third direction on upper side of another portion of the suction cap 55 located on the side of the black color ink chamber 55A.

Figure 8B:
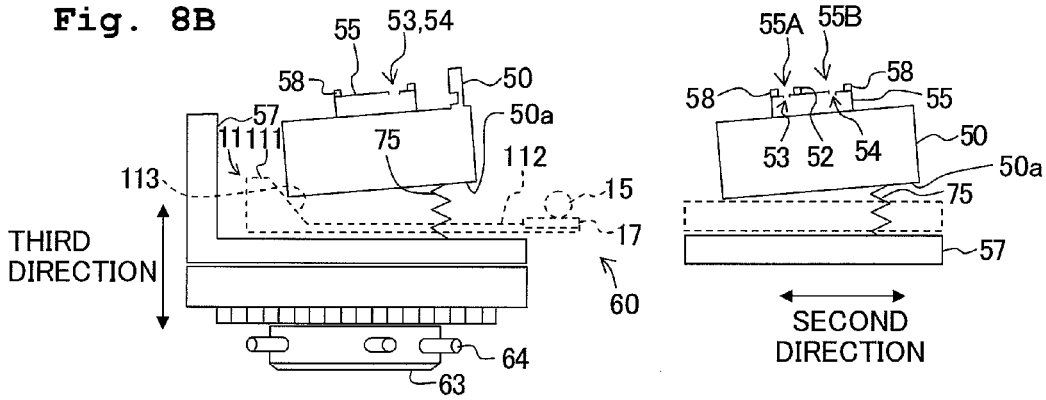

When the slide cam 11 slidably moves to the one side in the second direction (rightward in FIG. 8), then as shown in FIG. 8B, the suction cap 55 moves from the separate position toward the contact position in accordance with the height of the inclined surface 113. At this time also, the suction cap 55 is inclined by the urging force of the coil spring 75 so that with respect to the second direction, the portion of the suction cap 55 on the side of the suction ports 53, 54 is located in the third direction on the upper side of the another portion of the suction cap 55 on the opposite side to the suction ports 53, 54; and that with respect to the first direction, the portion of the suction cap 55 on the side of the color ink chamber 55B is located in the third direction on the upper side of the another portion of the suction cap 55 on the side of the black color ink chamber 55A. Note that in this situation, the inclination angle of the suction cap 55 is smaller than that shown in FIG. 8A.

Figure 8C:
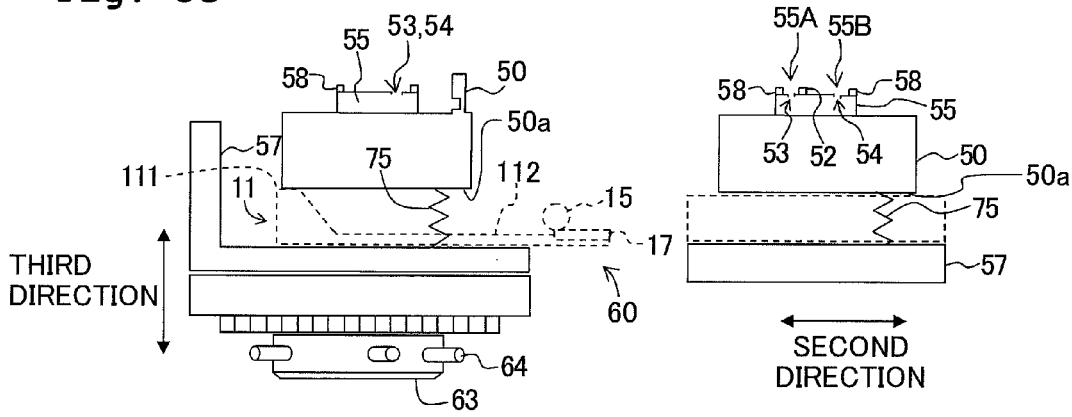

When the slide cam 11 further slidably moves to the one side in the second direction (rightward in FIG. 8), then as shown in FIG. 8C, the suction cap 55 is held at the contact position. At this time, the height position to which the outer frame section 50 and the suction cap 55 are pushed upward by the urging force of the coil spring 75 and the height position of the first guide surface 111 of the slide cam 11 become substantially identical. Therefore, the outer frame section 50 and the suction cap 55 are horizontal (level) in either of the first and second directions. Accordingly, it is possible to bring the suction cap 55 into contact with the nozzle surface 30.

Figure 9:
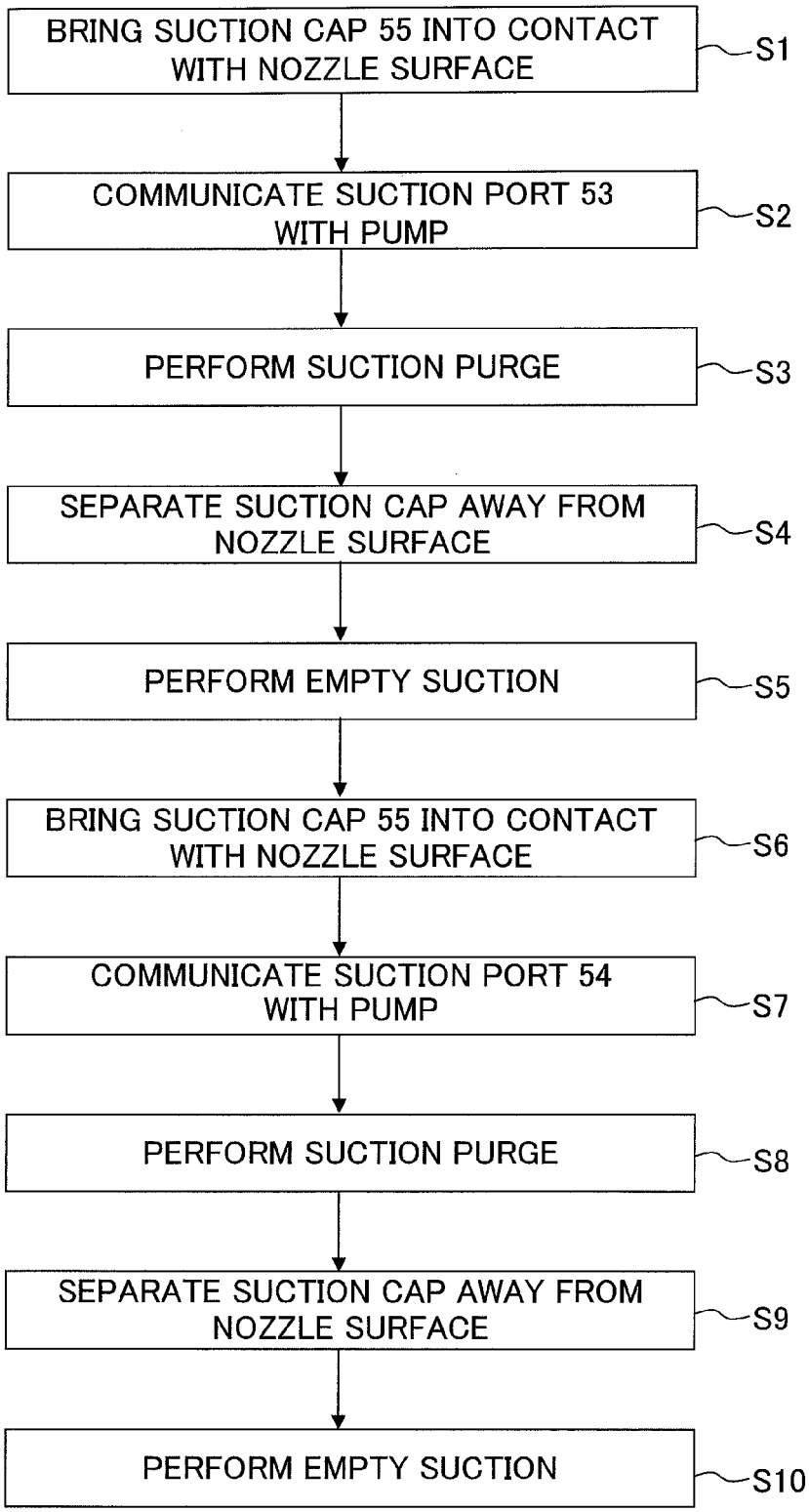
FIG. 9 is a flow chart showing steps in a purge process.

The purge process is performed in a state that the outer frame section 50 and the suction cap 55 are substantially horizontal in each of the first and second directions and that the suction cap 55 is brought into contact with the nozzle surface 30. In the following, steps of the purge process will be explained with reference to a flow chart shown in FIG. 9. At first, with the above-described procedure, the suction cap 55 is brought into contact with the nozzle surface 30 (S1). In a state that the suction cap 55 is brought into contact with the nozzle surface 30, the switchover valve 63 is switched to communicate the suction port 53 with the pump 110 (S2). The pump 110 is driven in this state to negatively pressurize a space surrounded by the black color ink chamber 55A of the suction cap 55 and the nozzle surface 30, thereby forcibly sucking the black color ink inside the nozzles 40 (S3: suction purge step). Next, the suction cap 55 is separated away from the nozzle 30 by moving the slide cam 11 in a procedure reverse to that performed for bringing the suction cap 55 into contact with the nozzle surface 30 (S4). The pump 110 is driven in a state that the suction cap 55 is separated away from the nozzle surface 30, thereby sucking the black color ink stored or accumulated inside the black color ink chamber 55A of the suction cap 55 (S5: empty suction step). Afterwards, the steps of Si to S5 are performed again to perform suction of the color ink. Specifically, the suction cap 55 is brought into contact with the nozzle surface 30 (S6). In a state that the suction cap 55 is brought into contact with the nozzle surface 30, the switchover valve 63 is switched to communicate the suction port 54 with the pump 110 (S7). The pump 110 is driven in this state to negatively pressurize a space surrounded by the color ink chamber 55B of the suction cap 55 and the nozzle surface 30, thereby forcibly sucking the color ink inside the nozzles 40 (S8: suction purge step). Next, the suction cap 55 is separated away from the nozzle surface 30 by moving the slide cam 11 in the procedure reverse to that performed for bringing the suction cap 55 into contact with the nozzle surface 30 (S9). The pump 110 is driven in a state that the suction cap 55 is separated away from the nozzle surface 30, thereby sucking the color ink stored or accumulated inside the color ink chamber 55B of the suction cap 55 (S10: empty suction step).

In the above explanation, the purge process is performed first for the black color ink and then the purge process is performed for the color ink. However, the present teaching is not limited to such an aspect; it is allowable to perform the purge process for the color ink before the purge process for the black color ink. Further, in the above explanation, the suction purge is performed to forcibly suck the ink inside the nozzles by the pump 110 in a state that the suction cap 55 is brought into contact with the nozzle surface 30. However, the present teaching is not limited to such an aspect; it is allowable, for example, to drive the discharge head 39 in the state that the suction cap 55 is brought into contact with the nozzle surface 30 and to discharge the black color ink or the color ink toward the suction cap 55, thereby forcibly discharge the ink inside the nozzles.

Here, when the suction cap 55 is moved to be separated away from the nozzle surface 30 after the purge process is completed, the state shown in FIG. 8C is changed to the state shown in FIG. 8B, and then the state shown in FIG. 8A is provided. Namely, when the suction cap 55 is being separated away from the nozzle surface 30, the suction cap 55 is inclined so that the portion of the suction cap 55 on the side of the black color ink chamber 55A is separated further from the nozzle surface 30 in the third direction by a distance greater than the another portion of the suction cap 55 on the side of the color ink chamber 55B, and is inclined so that the portion of the suction cap 55 on the side of the other end (opposite side to the suction ports 53, 54) is separated further from the nozzle surface 30 in the third direction by a distance greater than the another portion of the suction cap 55 on the one end side (side of the suction ports 53, 54).

The effects obtained by making the suction cap 55 assume such a posture will be explained with reference to FIG. 10.

As described above, in the embodiment, the suction cap 55 is configured to be rockable freely in three directions that are the first, second and third directions. Accordingly, there is a fear that the ink(s) might flow beyond the partition wall 52 depending on a rocking direction of the suction cap 55. At this time, for example, if the black color ink flows and enters from the side of the black color ink chamber 55A to the side of the color ink chamber 55B, the color ink chamber 55B is dirtied or stained by the black color ink. Such dirtiness inside the ink chamber in the suction cap cannot be completely removed only by sucking the ink from the cap chamber. As a result, when the suction purge process is performed again in a state that the color ink chamber is dirtied by the black color ink, there is a fear that the dirtied suction cap 55 might be brought into contact with the nozzle surface 30, which in turn might make the black color ink adhere to the color nozzles 40*b*, thereby dirtying the color ink nozzles 40*b*.

Figure 10:
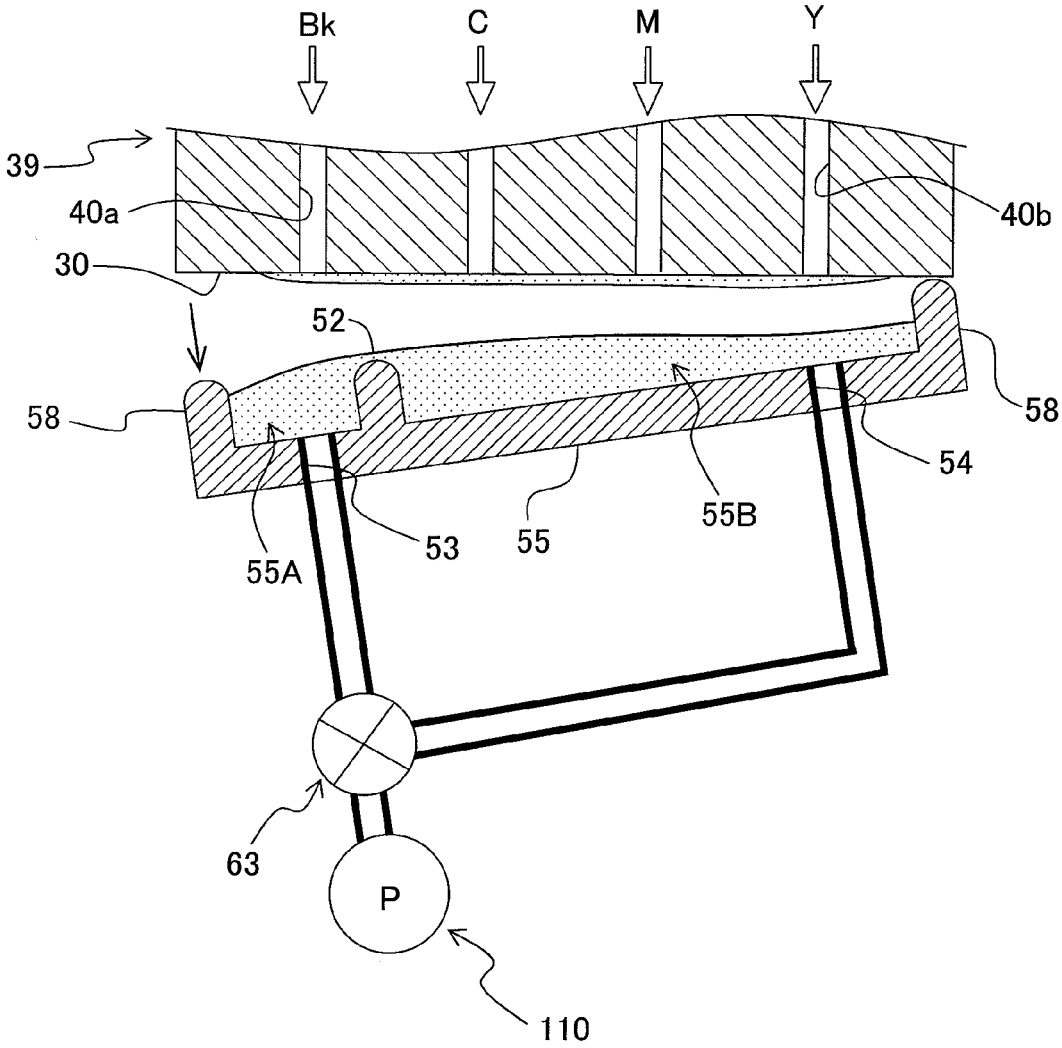
FIG. 10 is a cross-sectional view showing a state that the suction cap is separated away from a nozzle surface.

In the embodiment, as described above, the coil spring 75 urges the suction cap 55 in the third direction (up and down direction in FIG. 10) in the vicinity of the corner portion C located in the color ink chamber 55B at the side opposite to the black color ink chamber 55A in the first direction (left and right direction in FIG. 10) and is located at the one end side of the suction cap 55 in the second direction (direction perpendicular to the sheet surface of FIG. 10). With this, as shown in FIG. 10, the suction cap 55 is inclined so that the portion thereof on side of the black color ink chamber 55A is separated, in the third direction, further from the nozzle surface 30 by a distance greater than another portion of the suction cap 55 on the side of the color ink chamber 55B when the suction cap 55 is being moved separate and away from the nozzle surface 30. Accordingly, even when the ink flows beyond the partition wall 52, it is possible to make the color ink inflow to the side of the black color ink chamber 55A, rather than the black ink inflows to the side of the color ink chamber 55B. As a result, even if the color ink inflows into and mixes with the black color ink, the influence to the hue or color of the black color ink is small, and it is possible to make the influence on the color of the ink be greatly smaller than in a case that the black color ink enters into and mixes with the color ink. Therefore, it is possible to suppress the dirtying of the color nozzles 40 due to the black color ink.

Wit the embodiment, in particular, the following effect can also be obtained. Namely, after the suction purge step is completed for the black color ink or the color ink, the suction cap 55 is moved to be separate and away from the nozzle surface 30 in the third direction. At this time, immediately after the completion of the suction purge step, the ink is stored (accumulated) in the inner space of the suction cap 55. In a case that the suction cap 55 is being separated away from the nozzle surface 30 while being inclined, the ink flows, owning to the action of surface tension, from a portion, of the suction cap 55, separated from the nozzle surface 30 by a greater separating distance in the third direction to another portion, of the suction cap 55, separated from the nozzle surface 30 by a smaller separating distance. In this embodiment, the coil spring 75 urges the portion, of the suction cap 55, on the one end side in the second direction as described above. Therefore, with respect to the third direction, the separating distance at the portion of the suction cap 55 on the one end side is smaller than the separating distance at the another portion of the suction cap 55 on the other end side. Consequently, the ink flows from the other end side to the one end side in the suction cap 55, as described above. Further, the suction ports 53, 54 are provided on the one end side in the second direction of the suction cap 55. With this, it is possible to efficiently suck the ink flowed and gathered from the other end side to the one end side of the suction cap 55, owing to the action of surface tension.

In the embodiment, the outer frame section 50 which supports the suction cap 55 and the maintenance base 57 in which the outer frame section 50 is installable are provided on the printer 2. Further, the coil spring 75 is provided between the maintenance base 57 and the bottom surface of the outer frame section 50. With this construction, the outer frame section 50 is arranged with a predetermined clearance with respect to the maintenance base 57 so that the outer frame section 50 is freely rockable in each of the first, second and third directions. With this, it is possible to rockably support the suction cap 55 three-dimensionally via the outer frame section 50, and to assuredly realize a construction capable of efficiently suppressing the dirtying of the nozzle surface 30.

Further, in the embodiment, the groove portions 74 are formed in the maintenance base 57 to regulate the movement of the outer frame section 50 along the second direction, and to guide the projections 72, 73 respectively so that the outer frame section 50 moves in the third direction between the contact position at which the suction cap 55 is brought into contact with the nozzle surface 30 and the separate position at which the suction cap 55 is separated and away from the nozzle surface 30. As shown in FIG. 5, each of the groove portions 74 is constructed so that the width size in the second direction has a reverse tapered shape in which the width size is widened (expanded) in a direction toward the contact position from the separate position (see FIG. 7) of the suction cap 55 along the third direction, namely widened upward in the third direction. With this, while the suction cap 55 is moving in the third direction to the side at which the suction cap 55 is brought into contact with the nozzle surface 30, the suction cap is allowed to rockably move to a great extent in the second direction. Accordingly, the suction cap 55 is allowed to have a contact with the nozzle surface 30 while tolerating the variation in the install position of the nozzle surface 30, whereas in a state other than the above-described contact state, the rocking (swinging) motion of the suction cap 55 is suppressed to be small. In such a manner, it is possible to support the suction cap 55 stably.

Further, in the embodiment, the discharge head 39 is supported by the carriage 38 to be movable in the scanning direction. In such a construction, the discharge head 39 is transported to the maintenance device 51 by the carriage 38 when the maintenance such as the above-described purge operation is performed by the maintenance device 51. The abutting portion 37 is provided on the carriage 38; and the abutted portion 59 provided on the outer frame section 50 of the maintenance device 51 is brought into abutment with the abutting portion 37, thereby making it possible to define the posture of the suction cap 55. With this, even when the install position of the nozzle surface 30 is varied or deviated, the posture of the suction cap 55 is adjusted by the abutment function of the abutting portion 37 of the carriage 38, thereby making it possible to bring the nozzle surface 30 into contact with the suction cap 55 in an appropriate facing relationship.

Although the printer using the four color inks (black, cyan, magenta and yellow inks) is exemplified in the embodiment, there is no limitation to this, and it is allowable to apply the present teaching to a printer using three color inks (cyan, magenta and yellow inks). In such a case, the deep color ink (second ink) may be the cyan or magenta ink, and the light color ink (first ink) may be the yellow ink, and a construction similar to that of the embodiment may be provided. Further, the present teaching is not limited only to the application in which the printing is performed on paper or sheet, and may be applicable to an ink discharge apparatus which performs printing on a substrate, etc.

Note that the present teaching can be carried out while being modified in various ways within a scope or range without changing the gist or substance of the present teaching.

What is claimed is:

1. An ink discharge apparatus which discharges a first ink and a second ink having a color deeper than a color of the first ink, the ink discharge apparatus comprising:

a discharge head provided with a nozzle surface having a first nozzle which is formed in the nozzle surface and via which a liquid droplet of the first ink is discharged and a second nozzle which is formed in the nozzle surface and via which a liquid droplet of the second ink is discharged, the second nozzle being located at one side in a first direction in the nozzle surface, the first nozzle being located at an other side in the first direction in the nozzle surface; and a maintenance device which performs maintenance of the discharge head, the maintenance device including:

a suction cap which is brought into contact with the nozzle surface to cover the first and second nozzles, and which has a partition wall, a first suction port and a second suction port formed therein, the partition wall partitioning a space, defined between the suction cap and the nozzle surface in a state that the suction cap is brought into contact with the nozzle surface, into a first ink chamber facing the first nozzle and a second ink chamber facing the second nozzle, the first suction port being located in the first ink chamber, and the second suction port being located in the second ink chamber, a suction mechanism which is connected to the suction port of the first and second suction ports of the suction cap, and an urging mechanism which is located at only one corner portion of the suction cap, the urging mechanism being configured to urge the one corner portion in a third direction orthogonal to the nozzle surface;

a controller configured to control the maintenance device and the discharge head; and an apparatus body in which the maintenance device is arranged, wherein the one corner portion of the suction cap is located at an intersection of an end of an other side of the first ink chamber in the first direction, that is from the second nozzle toward the first nozzle and is parallel to the nozzle surface, and an end of one side of the first ink chamber in a second direction, that is orthogonal to the first direction and is parallel to the nozzle surface;

wherein the suction cap is arranged with respect to the apparatus body with a predetermined clearance so that the suction cap is rockable in each of the first direction, the second direction and the third direction;

wherein the first suction port is arranged in the first ink chamber of the suction cap at the end of the one side in the second direction; and wherein the second suction port is arranged in the second ink chamber of the suction cap at the end of the one side in the second direction;

wherein the suction cap inclines, while the suction cap is being separated from the nozzle surface, so that a portion of the suction cap, on the other side in the second direction is separated from the nozzle surface in the third direction by a greater distance than another portion of the suction cap on the one side in the second direction;

wherein the suction cap inclines, while the suction cap is being separated from the nozzle surface, so that a portion, of the suction cap, on the one side in the first direction is separated from the nozzle surface in the third direction by a greater distance than another portion, of the suction cap, on the other side in the first direction;

wherein the controller is configured to control the maintenance device and the discharge head to:

bring the suction cap into contact with the nozzle surface;

discharge one of the first and second inks from one of the first and second nozzles in the state that the suction cap is brought into contact with the nozzle surface;

separate the suction cap from the nozzle surface; and suck the one of the first and second inks via the suction mechanism in a state that the suction cap is separated from the nozzle surface.

2. The ink discharge apparatus according to claim 1, wherein the maintenance device further includes an outer frame section supporting the suction cap, and having a bottom portion and a maintenance base in which the outer frame section is installed;

the outer frame section is arranged with respect to the maintenance base with the predetermined clearance so that the outer frame section is rockable in each of the first direction, the second direction and the third direction; and the urging mechanism is arranged between the maintenance base and the bottom portion of the outer frame section.

3. The ink discharge apparatus according to claim 2, wherein the outer frame section has a first side surface and a second side surface which are arranged to face with each other in the first direction, and projections projecting from the first and second side surfaces are formed in the first and second side surfaces;

the maintenance base includes groove portions which regulate movement of the outer frame section in the second direction by engaging with the projections of the outer frame section, and which guide the projections so that the outer frame section moves in the third direction between a contact position at which the suction cap is brought into contact with the nozzle surface and a separate position at which the suction cap is separated from the nozzle surface; and each of the groove portions includes a tapered portion having a first width size, in the second direction, at a top portion that is greater than a second width size, in the second direction, at a bottom portion opposite the top portion.

4. The ink discharge apparatus according to claim 2, further comprising a carriage which supports the discharge head to be movable in the first direction;

wherein the carriage includes an abutting portion which regulates posture of the suction cap under a condition that a part of the suction cap is brought into contact with the nozzle surface; and the outer frame section includes an abutted portion against which the abutting portion abuts.

5. The ink discharge apparatus according to claim 1, wherein the first ink is a color ink and the second ink is a black ink.

6. The ink discharge apparatus according to claim 1, wherein the controller is configured to control the maintenance device and the discharge head to:

bring the suction cap into contact with the nozzle surface again, after sucking the one of the first and second inks via the suction mechanism in the state that the suction cap is separated from the nozzle surface;

discharge the other of the first and second inks from the other of the first and second nozzles in the state that the suction cap is brought into contact with the nozzle surface;

separate the suction cap from the nozzle surface; and suck the other of the first and second inks via the suction mechanism in the state that the suction cap is separated from the nozzle surface.

7. The ink discharge apparatus according to claim 3, wherein each of the projections is positioned in one of the groove portions when the outer frame section is at the contact position and when the outer frame section is at the separate position.

8. The ink discharge apparatus according to claim 2, wherein the maintenance device further comprises a slide cam configured to support the outer frame section and configured to move in the second direction, and a pinion gear configured to transmit a force for moving the slide cam in the second direction, and wherein the slide cam comprises an extending portion extending beyond the outer frame section at one side in the second direction, and a rack gear positioned at the extending portion to engage the pinion gear.

9. The ink discharge apparatus according to claim 8, wherein the slide cam comprises a sloped surface at the other side of the slide cam in the second direction and the sloped surface contacts a bottom surface of the outer frame section.

* * * * *